US010028596B2

(12) United States Patent
Markwick et al.

(10) Patent No.: US 10,028,596 B2
(45) Date of Patent: Jul. 24, 2018

(54) PRODUCT DISPLAY FOR MULTIPLE PRODUCT CONFIGURATIONS

(71) Applicant: Kimberly-Clark Worldwide, Inc., Neenah, WI (US)

(72) Inventors: Barry P. Markwick, Johns Creek, GA (US); Adrienne A. Hershey, Sr., Cumming, GA (US); Teuta Elshani, III, Woodstock, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/319,196

(22) PCT Filed: Jun. 30, 2014

(86) PCT No.: PCT/US2014/044921

§ 371 (c)(1),
(2) Date: Dec. 15, 2016

(87) PCT Pub. No.: WO2016/003425

PCT Pub. Date: Jan. 7, 2016

(65) Prior Publication Data

US 2017/0119178 A1 May 4, 2017

(51) Int. Cl.
*A47F 5/00* (2006.01)
*G09F 23/00* (2006.01)

(52) U.S. Cl.
CPC ..... *A47F 5/005* (2013.01); *A47F 5/0068* (2013.01); *G09F 23/00* (2013.01)

(58) Field of Classification Search
CPC ..... G09F 23/00; B65D 1/36; B65D 2577/043; B65D 2577/047; B65D 21/0201; B65D 21/0204; B65D 21/0206; B65D 21/0212; A47F 5/005; A47F 5/0025; A47F 5/0068
See application file for complete search history.

(56) References Cited

U.S. PATENT DOCUMENTS

| | | | | |
|---|---|---|---|---|
| 3,187,924 A | | 6/1965 | William | |
| 3,648,849 A | * | 3/1972 | Harris | A47B 63/00 206/503 |
| 3,791,528 A | | 2/1974 | Brendgord | |
| 4,074,810 A | * | 2/1978 | Juergens | B42F 7/12 211/11 |
| D248,805 S | | 8/1978 | Bridges | |
| 4,228,906 A | | 10/1980 | Jones | |
| 4,322,006 A | | 3/1982 | Marschak | |
| 4,384,647 A | | 5/1983 | Schweizer | |
| 4,401,222 A | | 8/1983 | Kulikowski et al. | |
| 4,429,796 A | | 2/1984 | Sussman | |

(Continued)

FOREIGN PATENT DOCUMENTS

| | | |
|---|---|---|
| EP | 0 327 685 A1 | 8/1989 |
| GB | 1 223 738 A | 3/1971 |

(Continued)

*Primary Examiner* — Patrick D Hawn

(57) ABSTRACT

A product display system (10) suitable for positioning different packaged products for use in a single location, the product display system (10) including at least two trays (12) that are connected to each other by at least one bracket (14), further including a messaging panel (16) which is inserted into either a tray (12) or a bracket (14).

11 Claims, 9 Drawing Sheets

(56) References Cited

U.S. PATENT DOCUMENTS

| | | | | |
|---|---|---|---|---|
| 4,438,852 | A * | 3/1984 | Evans | B42F 17/02 206/558 |
| 4,480,745 | A | 11/1984 | Loge et al. | |
| 4,494,658 | A * | 1/1985 | Simon | G09F 23/06 206/558 |
| D282,702 | S | 2/1986 | Maus | |
| 4,889,254 | A | 12/1989 | Vola | |
| 5,000,329 | A * | 3/1991 | Luberto | A47F 5/11 211/132.1 |
| 5,192,042 | A * | 3/1993 | Wotring | H01H 9/025 211/194 |
| 5,265,735 | A | 11/1993 | Hassel et al. | |
| 5,547,098 | A | 8/1996 | Jordan | |
| 5,890,605 | A | 4/1999 | Percudani | |
| 6,129,220 | A | 10/2000 | Decossas | |
| 6,902,242 | B2 | 6/2005 | Horn | |
| D617,989 | S | 6/2010 | Naden et al. | |
| 7,762,410 | B2 * | 7/2010 | Colin | A47F 5/10 108/107 |
| D663,981 | S | 7/2012 | Purcell et al. | |
| D667,503 | S | 9/2012 | Ranby | |
| 9,585,497 | B2 * | 3/2017 | Luo | A47F 5/0025 |
| 9,649,010 | B2 * | 5/2017 | Oh | A47J 47/16 |
| 2002/0079313 | A1 | 6/2002 | Grayson | |
| 2002/0162842 | A1 | 11/2002 | Pangerc et al. | |
| 2005/0252940 | A1 | 11/2005 | Brandstetter et al. | |
| 2006/0108368 | A1 | 5/2006 | Dube et al. | |
| 2006/0273084 | A1 | 12/2006 | Baker et al. | |
| 2008/0121563 | A1 | 5/2008 | Polvere et al. | |
| 2009/0301912 | A1 | 12/2009 | Cornell | |
| 2010/0133132 | A1 | 6/2010 | Allan | |
| 2010/0187251 | A1 | 7/2010 | Simmons | |
| 2010/0243836 | A1 | 9/2010 | Gluck | |
| 2011/0120993 | A1 | 5/2011 | Birchmeier et al. | |
| 2012/0048892 | A1 | 3/2012 | Van Der Heijden et al. | |
| 2014/0097119 | A1 | 4/2014 | Zabinski et al. | |

FOREIGN PATENT DOCUMENTS

| | | | |
|---|---|---|---|
| GB | 2 037 572 | A | 7/1980 |
| GB | 2 246 508 | A | 2/1992 |
| GB | 2 301 814 | A | 12/1996 |
| GB | 2 399 736 | A | 9/2004 |
| GB | 2 483 215 | A | 3/2012 |
| WO | WO 2009/100492 | A1 | 8/2009 |

* cited by examiner

PRODUCT DISPLAY FOR MULTIPLE PRODUCT CONFIGURATIONS

TECHNICAL FIELD

The present invention is directed to a product display system and more particularly to a product display system that accommodates multiple products having different packaging configurations.

BACKGROUND OF THE DISCLOSURE

To enhance the hygiene of the public and in an effort to reduce the transmission of viruses and other contaminants, products such as surface wipes, hand wipes, hand sanitizer, tissues and other hand care, air care or surface cleaning products may be positioned or displayed so that people passing these displays remove wipes, tissues or dispense hand sanitizer or moisturizer for their personal use. For public areas such as office buildings, airports, government buildings, grocery stores and concert halls it is convenient to display multiple products in a single location. These products may be intended for placement and use in offices, restrooms, food preparation/consumption areas, conference rooms, hallways and other areas in these and other facilities.

Certain product display systems are designed in such a way that only one product or two similarly-shaped products are able to fit within that display system. It can be more economical and environmentally friendly to utilize flexible product display and dispensing systems which fit multiple products having different packaging configurations.

SUMMARY OF THE DISCLOSURE

Objects and advantages of the invention will be set forth in part in the following description, or may be obvious from the description, or may be learned through practice of the invention.

A product display system is described herein that includes at least two or more trays, a bracket configured to connect at least two trays together and a messaging panel which may be attached to either one or more of the trays or one or more of the brackets.

The trays may have different shapes, permitting them to be connected via brackets to form product display systems having various configurations.

Each tray includes a product recess configured to hold multiple products having different packaging configurations. The product recess may include at least three surfaces configured to support such packaged products.

At least one slot may be provided in each tray or bracket. In some embodiments, one or two slots may be provided in each tray. The slot may extend partially into one of the surfaces or, in some embodiments, may extend through one of the surfaces. In selected embodiments, a ridge extends downwardly from the same surface into which the slot extends.

The one or more brackets used in the present invention may include a first end and a second end and includes at least two walls spaced part from and extending parallel to each other. The walls of particular embodiments of the product display system may include an upper edge and a lower edge. The upper edge of one or more walls may be configured to engage the trays so that the upper edge of a wall is positioned behind the ridge of each tray. In some embodiments of the bracket, one or more notches may be formed in the upper edge of at least one wall. The notches may perform a number of different functions, including permitting proper engagement of the message panels with the trays, increasing the ease with which the bracket may be connected to the tray or the manufacturability of the bracket.

The brackets may include a fastener which permits the first end of one bracket to be attached to a second end of a different bracket. An exemplary fastener may include two interlocking portions, each portion located at an opposite end of the brackets. In this manner the two brackets may be fastenened together in in an end-to-end configuration. The interlocking portions may comprise a hook and loop fastener, a hinged latch and post or other suitable mechanisms such as adhesive.

The messaging panel preferably includes a first surface and at least one projection that can engage at least one slot or other opening in the tray or the bracket.

The product recess may also be specifically configured to accept at least two or at least three packaged products, each packaged product having a different lower exterior configuration than the other packaged product. Some embodiments of the present invention may be configured to accept and display at least four packaged products having a different lower exterior configuration that the other packaged products.

Some products may have lower exterior configurations that are formed only of flat surfaces, edges which are straight lines and vertices (polyhedrons).

Selected embodiments of the product display system may include a bracket having a partition that is positioned between the two walls of the bracket. The partition may provide enhanced rigidity and stability to the bracket.

The invention will be described in greater detail below by reference to particular embodiments illustrated in the drawings.

Figure 1:
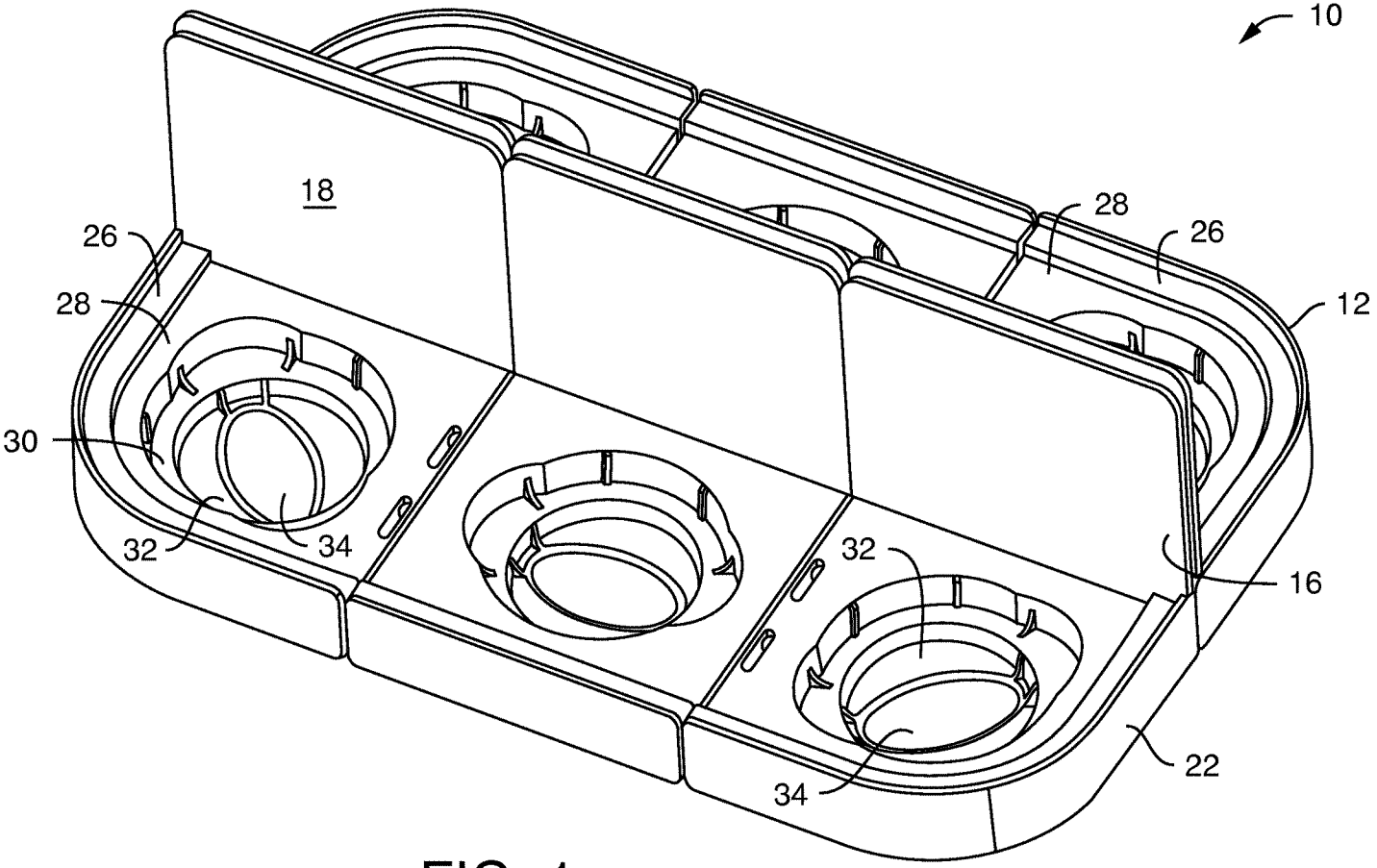
FIG. 1 is a perspective view of a product display system according to the present invention.

Repeat use of reference characters in the present specification and drawings is intended to represent the same or analogous features or elements of the disclosure.

DETAILED DESCRIPTION OF THE DISCLOSURE

Reference will now be made in detail to embodiments of the invention, one or more examples of which are illustrated in the figures. Each example is provided by way of explanation of the invention, and not meant as a limitation of the invention. For example, features illustrated or described as part of one embodiment may be used with another embodiment, to yield still a further embodiment.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. It should be appreciated by those skilled in the art that various modifications and variations may be made to features of the invention described herein, without departing from the scope and spirit of the invention. It is intended that the invention include all such variations.

Figure 2:
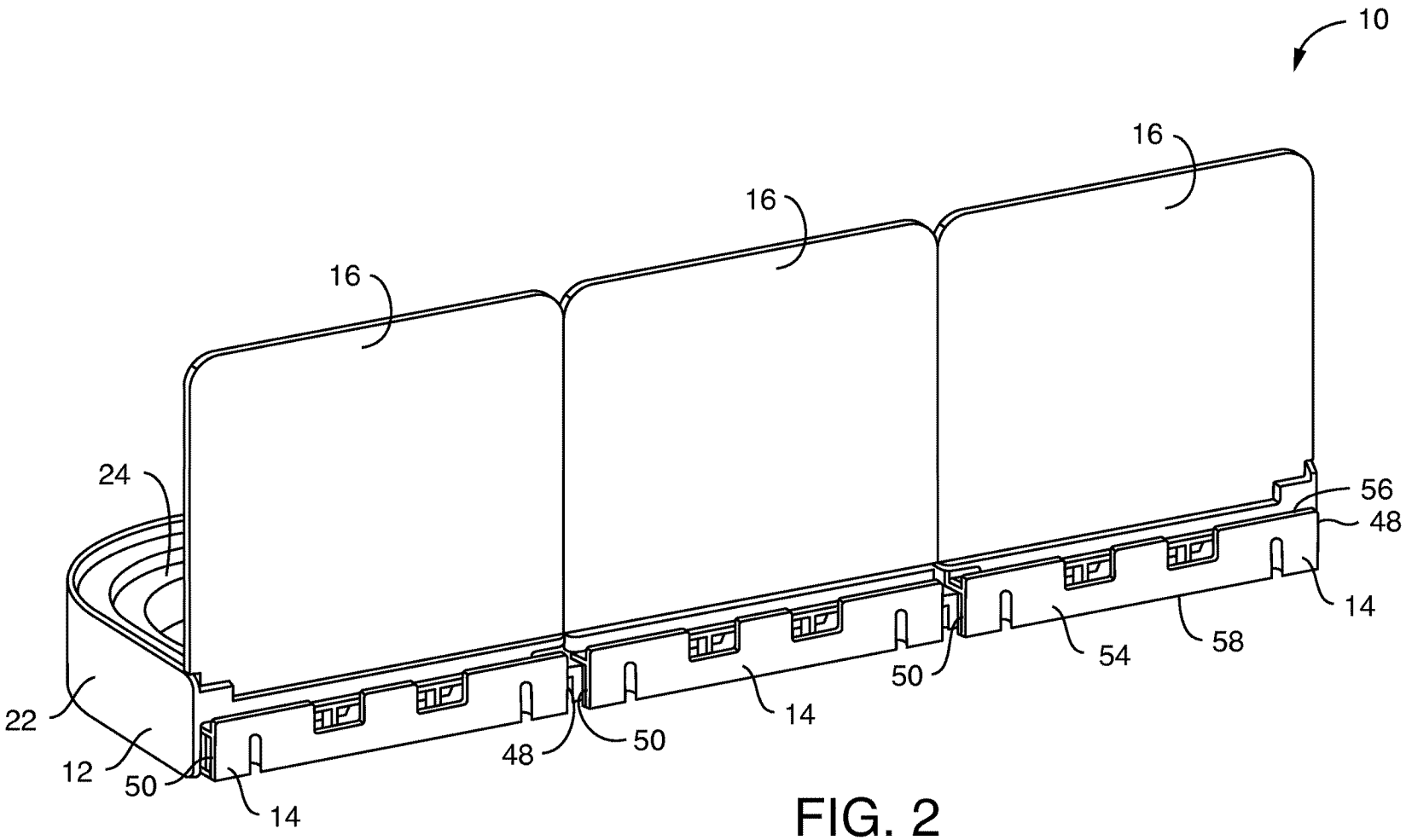
FIG. 2 is another perspective view of a product display system according to the present invention.
Figure 12:
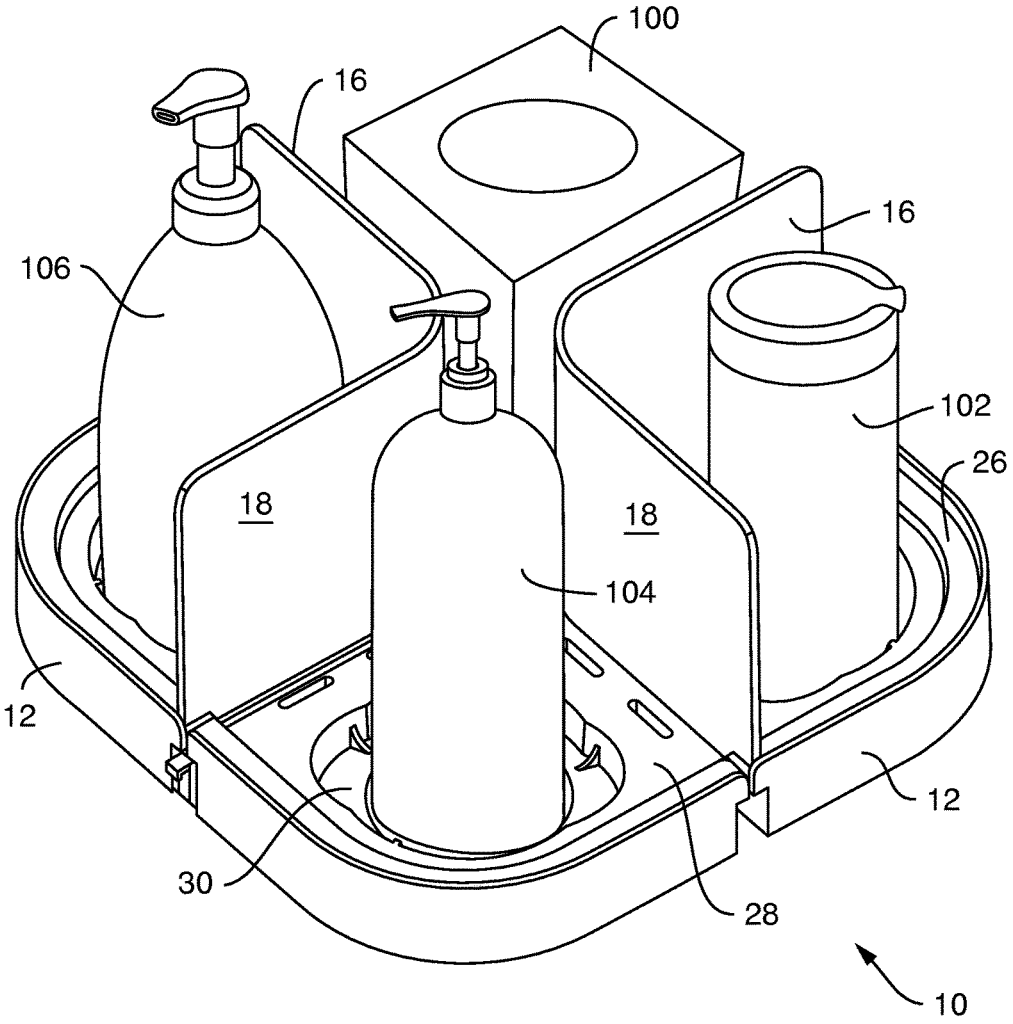
FIG. 12 is an alternate configuration of the product display system according to the present invention.

The present invention is directed to a product display system 10 which is best seen in FIGS. 1, 2 and 12. The product display system 10 includes at least two trays 12 and, in many embodiments will include three or more trays 12. The trays 12 are removably joined together by at least one bracket 14. The product display system 10 may be assembled into a number of different configurations containing 2, 3, 4, 5, 6 or more trays which enable the display and dispensing of products in a convenient and economical manner.

The product display system 10 also includes a messaging panel 16 which has at least a first surface 18 onto which a message, advertisement, image or wording may be placed. The message panel 16 is, in some embodiments, positioned in close proximity to the product to be dispensed so that it may provide the user with relevant and helpful information.

Figure 3:
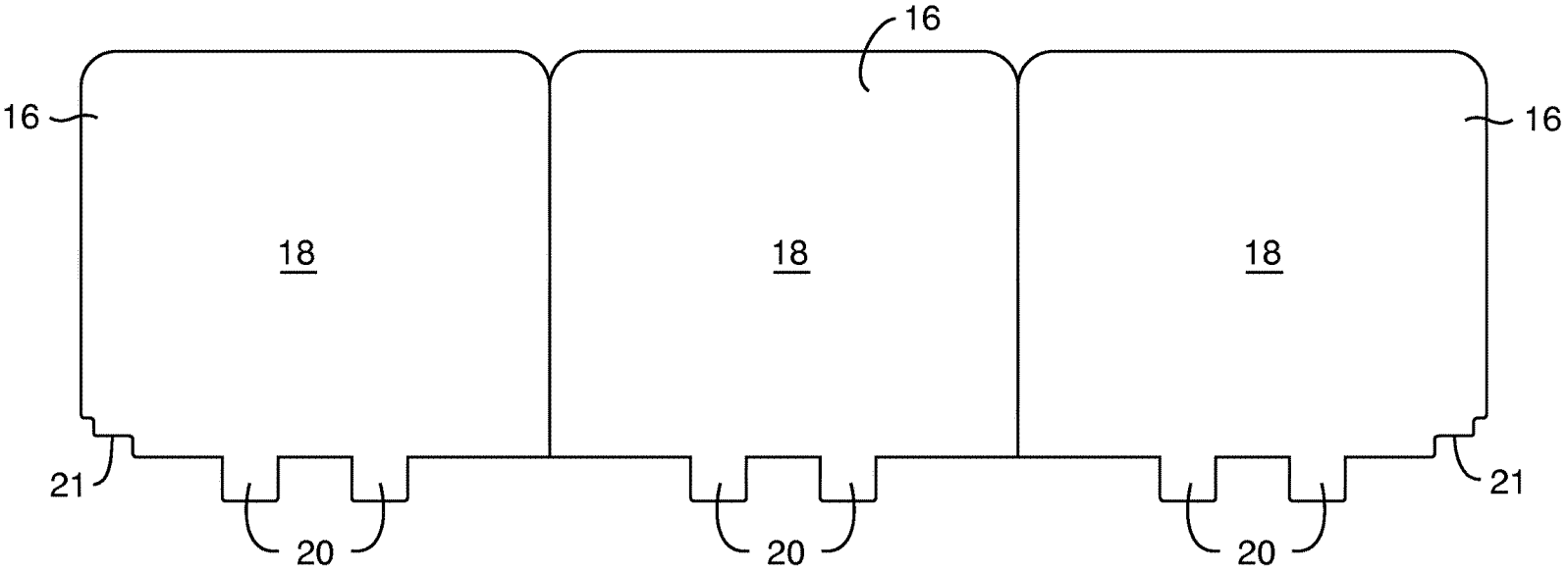
FIG. 3 is a front view of several messaging panels of a product display system according to the present invention.

As seen in FIG. 3, the messaging panel 16 may include projections 20 which extend downwardly from the messaging panel 16. Each tray 12 may include two slots 36, 38 which extend at least partially into one of the surfaces of the tray 12. The projections 20 of the messaging panel 16 may be configured to be placed within the slots 36, 38. The shape of the messaging panels 16 may vary widely and may include notches 21 which adapt the shape of a portion of the messaging panels 16 to one or more configurations of the tray 12. The configuration of the messaging panels 16 may be such that one messaging panel 16 may extend across one or more trays 12. The messaging panels 16 may be planar and/or curved, such as the messaging panels 16 shown in FIGS. 12.

The messaging panels 16 may be formed so that different messages may be placed on the panels by using temporary or permanent adhesion methods. For example, messaging panels 16 may be constructed of a material which permits easy application and removal of stickers. The information provided on the messaging panels 16 may simply be printed on the panels 16 and new messaging panels 16 may be inserted into the product display system 10 as appropriate. Select messaging panels 16 may be formed to include pockets into which information may be placed. In some embodiments the pockets may be transparent and the information may be contained entirely within the pocket. In other embodiments the pockets may be opaque and the information may be positioned only partially within the pocket.

As shown in FIG. 1, the product display system 10 is rectangular and may include six trays 12. The four trays 12 which occupy the corners of the rectangular product display system 10 are manufactured so that each tray has three corners which are formed into right angles and one corner which is rounded, the rounded corner of the tray 12 forming the corner of the display system 10. The two trays 12 which occupy the interior positions in the rectangular product display system 10 have four corners which are formed as right angles. The trays 12 are not limited to square or substantially square shapes. Trays may be formed in many shapes but it is preferred that each tray include at least one side wall 22 which is adapted to be joined to another tray 12 by a bracket 14. In some embodiments, these connecting side walls 22 of trays 12 and the bracket 14 may be curved.

FIG. 12 depicts a product display system 10 which includes four trays 12, each of the trays 12 have one rounded corner and are connected to each other via brackets 14 (not shown). Into each of the trays 12 is positioned a different packaged product that is intended to be dispensed to a person as needed. Curved message panels may be utilized to provide information to users as shown in FIG. 12.

Referring now to FIGS. 1 and 4-6, each tray 12 may include a supporting wall 22 and a product recess 24. The product recess 24 includes different surfaces such as surfaces 26, 28, 30, 32 and 34. Each of the surfaces is configured to support one or more products. As seen in FIGS. 1 and 12, a product may be securely positioned on each surface, and preferably a different product may be positioned on each surface. The product display system 10 in some configurations may be formed so that the product recess 24 accepts three packaged products, each packaged product having a lower exterior configuration that is different than the other two packaged products. As used herein, the term "base" means the bottom surface of the packaged product, and "lower exterior configuration" of the packaged product means the base of the packaged product and the portions of the packaged product that are adjacent to the base and which fit into or otherwise interact with the respective recess of the tray 12. In the rear-most tray 12 of the product display system of FIG. 12 is a cube-shaped package 100 of facial tissues. Facial tissues and other dry wipes and tissues frequently are sold in polyhedron packaging such as cubes and rectangles and may rest on surfaces 26 or 28. The lower exterior configuration of the package 100 is not shown but similar commercially available packages have a lower exterior configuration which has a square or rectangular base and straight upwardly extending sides.

The cylindrical canister 102 in FIG. 12 is similar to packaging which is commonly used to contain wet wipes for hand hygiene or surface cleaning. The lower exterior configuration of the canister 102 may be generally cylindrical. The bottom of the canister 102 may be substantially flat or include embossments. Although not shown, the canister 102 rests on surface 32.

Figure 5:
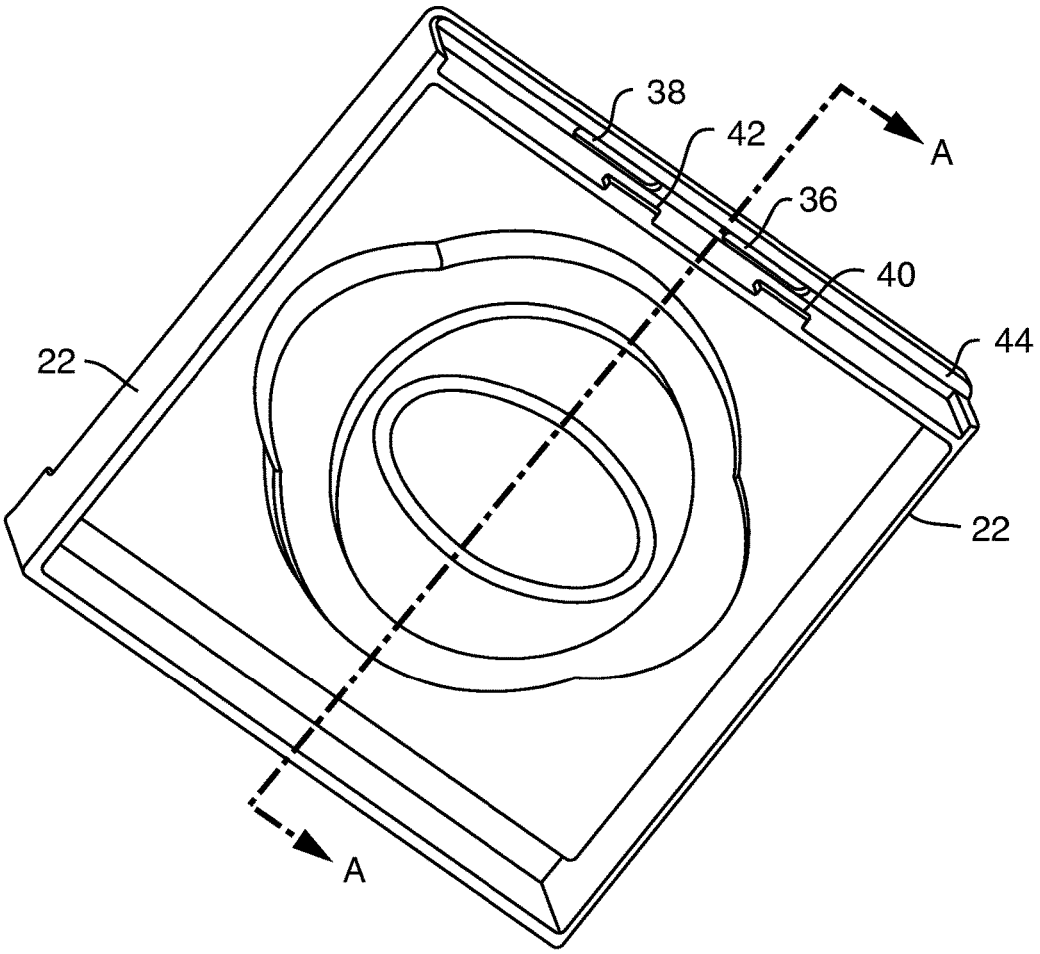
FIG. 5 is a different perspective view of the tray depicted in FIG. 4.

The pump dispenser 104 is similar to containers which are used to dispense liquids or gels such as hand sanitizers, lotions and the like. The pump dispenser 104 shown in FIG. 12 has a base that is elliptical and preferably rests on surface 34. An additional pump dispenser 106 is positioned in the product dispensing system 10. The pump dispenser 106 has a base which is also elliptical and is preferably positioned on surface 30. As shown in FIGS. 1 and 5, the surface 30 may be configured to accept packaged products which have either circular or elliptical bases.

The product display system 10 may include trays 12 having a recess 24 that is configured to accept three packaged products having lower exterior configurations that differ from each other. In some embodiments, the recess 24 may be configured to accept at least two additional packaged products. In particular configurations, the recess 24 may be configured to accept at least one packaged product that has lower exterior configuration that is a polyhedron. Other configurations of the recess 24 may be configured to accept at least one packaged product that has a lower exterior configuration that is a non-polyhedron.

Figure 4:
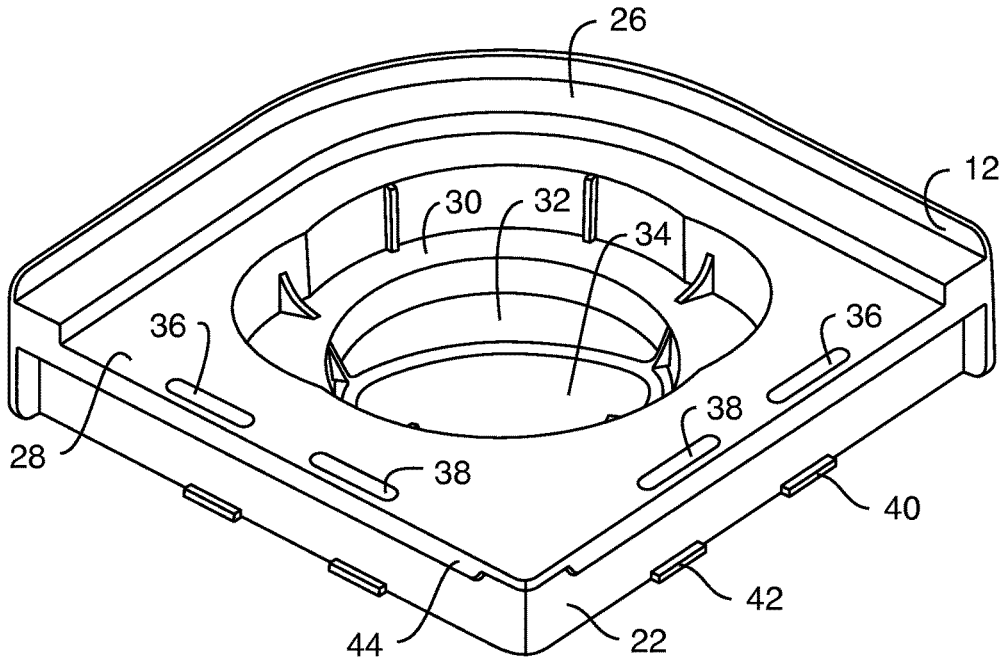
FIG. 4 is a perspective view of a tray of the product display system according to the present invention.
Figure 6:
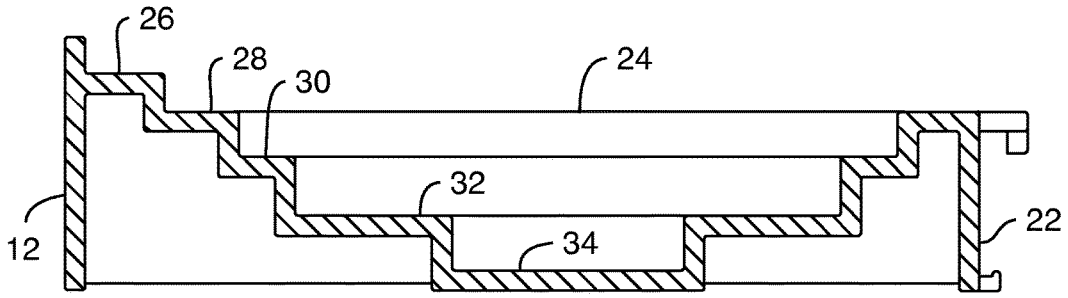
FIG. 6 is a cross-sectional view of the tray depicted in FIG. 4 taken along lines A-A.

The embodiment of the tray 12 shown in FIGS. 4-6 includes five exemplary surfaces although three to seven or more surfaces may be used. The surface 26 extends around the outermost edge of the tray and is the surface nearest to the supporting wall 22. The surface 26 would be best suited to support a larger product such as tissue box 100 shown in FIG. 12. Other products such as dry wipers and tissues are commonly contained in polyhedron packaging that is suitable for placement onto surface 26. Additionally, large non-polyhedral shaped products may also be suitable to be supported by surface 26, and in preferred embodiments these products will have bases that are substantially planar.

The surface 28 is recessed below the surface 26 and is also suitable to support a product having a flat base. Formed in the surface 28 in the embodiment depicted in FIG. 1 are the slots 36 and 38 which may extend into or fully through the surface 28. The slots 36 and 38 may alternately be formed in other surfaces of the tray 12.

The surface 30 is recessed below the surface 28 and is configured to accept packaged products having round or elliptical bases. The surface 32 is recessed below the surface 30 and is configured to accept products having round bases. The surface 34 is recessed below the surface 32 and is configured to accept products having elliptical bases. Of course, any packaged product that has a base which is sufficiently sized to fit within any of the recessed surfaces may have a shape other than the shape of the recessed surface. For example, a square peg can fit within a round hole so long as the widest dimension of the square peg is smaller than the diameter of the round hole.

Another feature of the present invention is that a cover may be placed onto any of the surfaces 26, 28, 30, 32 and 34, the cover resting on one of the surfaces. In some embodiments the cover may be planar and in other embodiments the cover may have recessed surfaces which are different than the surfaces 28, 30, 32 and/or 34 of the tray 12. In this manner, the cover may be used to temporarily alter the configuration of the product recess 24 in the tray 12.

The trays 12 may be positioned side by side in groups of two or three or larger groups of 6 and 8. The configuration of the trays may vary. Alternate embodiments of the product display system 10 shown in FIG. 1 include arrangements of four or more trays 12 on each side of the display 10 by adding a tray 12 having no rounded corners to each side of the display 10. Selected embodiments of the product display system 10 may include a disparate number of trays 12 on each side of the product display system.

In some embodiments, braces 40 and 42 are positioned below the slots 36 and 38. The braces 40, 42 may function to provide a surface on which the lowermost portion of the projection 20 may rest. As seen in FIG. 4, a ridge 44 may extend downwardly from the surface 28 and around at least a portion of the tray 12. The ridge 44 may have a variety of functions including adding rigidity to the tray 12 and acting as a guide for the projections 20 as they are inserted into the slots 36, 38.

Referring to FIGS. 2 and 7-11, the product display system 10 includes at least one bracket 14 that has a first end 48 and a second end 50. In some embodiments the bracket 14 may also include two walls 54, 64 that are spaced part from and extend parallel to each other. The walls 54, 64 may be separated by a partition 62 which can be variously configured to support, connect and provide stabilization to the walls 54, 64. For example and as shown in FIGS. 7-11, the support 62 includes a number of portions which are spaced apart from each other and which interconnect the walls 54, 64.

Each wall 54, 64 preferably include an upper edge 56, 66 respectively and a lower edge 58, 68 respectively. As shown in FIGS. 2, 4 and 7-11, each wall 54, 64 may be configured to engage at least one tray 12 so that the upper edge 56, 66 respectively of the wall 54, 64 is positioned behind the ridge 44 of the tray 12. In some embodiments, the bracket 14 may be formed as a single wall having features similar to those in the figures.

At least one notch 52 is preferably formed in the upper edge 56, 66 of the walls 56, 54 respectively for selected embodiments of the bracket 14. The notches 52 may permit the bracket 14 to be more easily connected to the trays 12 and increase the flexibility of the bracket 14 so that the product display system 10 may be moved without separating one or more of the trays 12 from the bracket 14.

Figure 7:
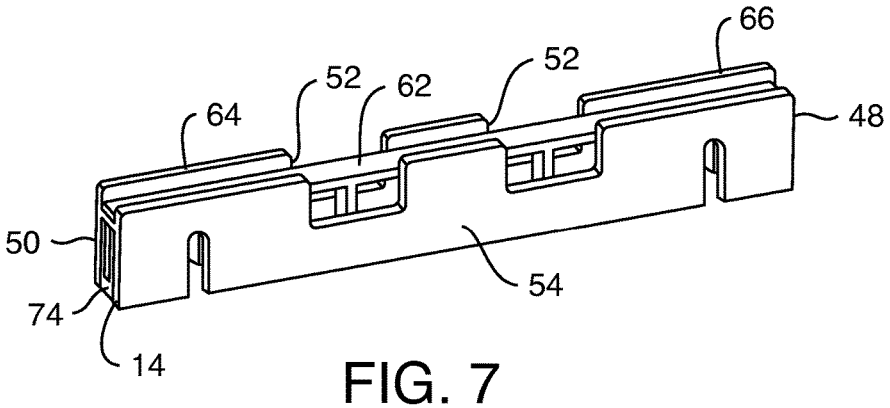
FIG. 7 is a perspective view of a bracket of the product display system according to the present invention.
Figure 8:
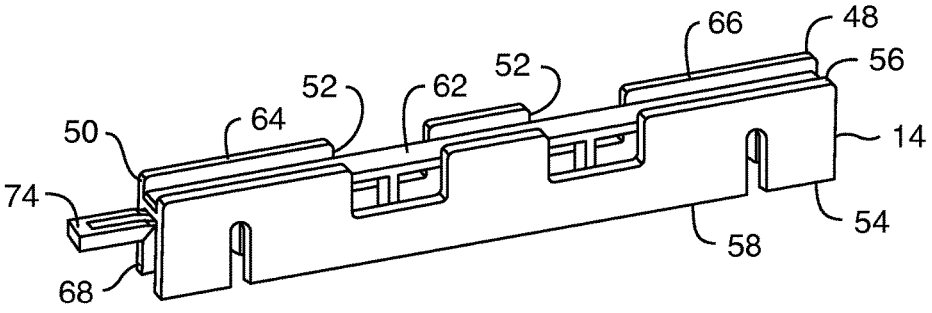
FIG. 8 is a perspective view of the bracket depicted in FIG. 7 in which the second interlocking portion is shown in its raised position.
Figure 9:
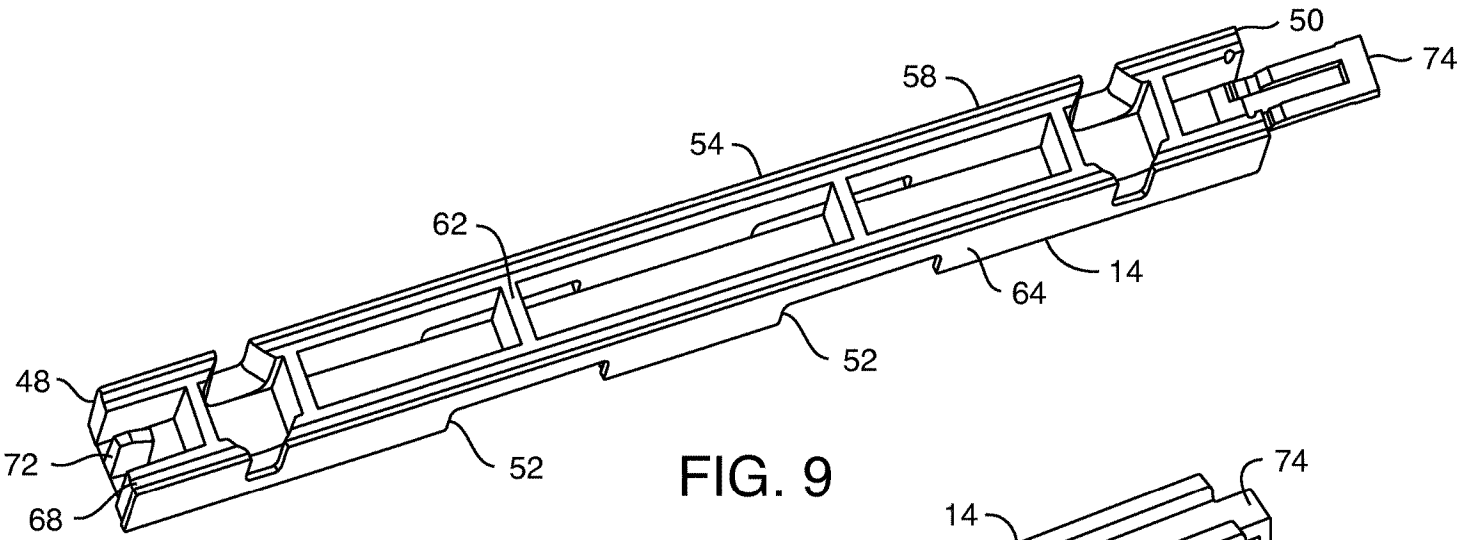
FIG. 9 is a different perspective view of the bracket shown in FIG. 8.

A fastener 70 having two interlocking portions 72, 74 may also be included in the present invention. As shown in the embodiments in FIGS. 7-11, first interlocking portion 72 and second interlocking portion 74 are located at opposite ends 48, 50 respectively of the bracket 14, enabling two brackets to be fastened together in an end-to-end configuration by engaging the first interlocking portion 72 positioned on the first end 48 of a particular bracket 14 with the second interlocking portion 74 on the second end 50 of a different bracket 14. FIGS. 7, 8 and 9 show a particular fastener 70 which includes a first interlocking portion 72 that is formed as a boss extending outwardly from the bracket 14. The second interlocking portion 74 is configured as a latch 74 which extends outwardly from the end 50 of another bracket 14.

Figure 10:
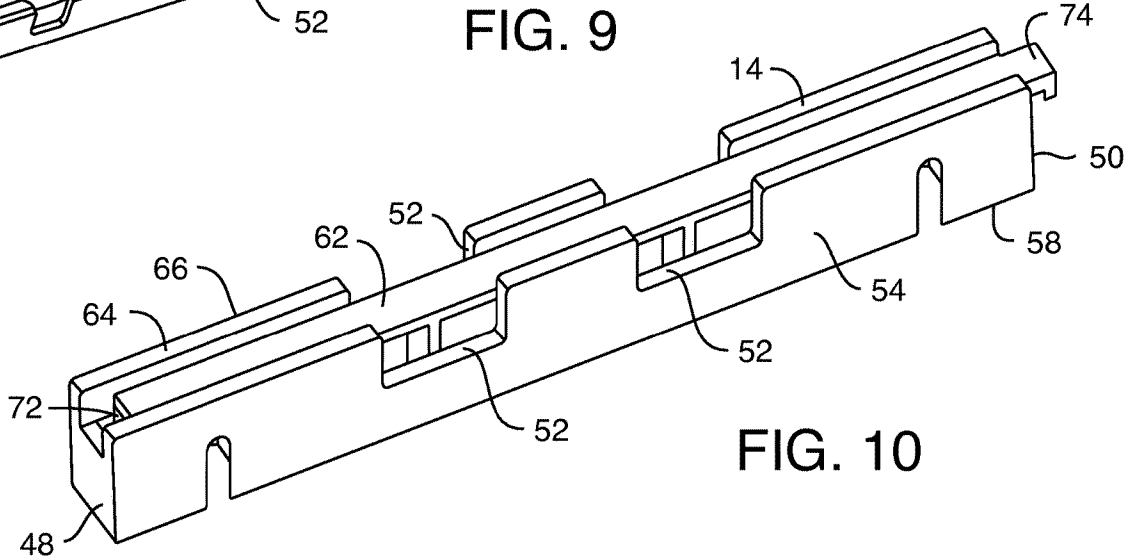
FIG. 10 is a perspective view of an alternate bracket suitable for use in the product display system according to the present invention.
Figure 11:
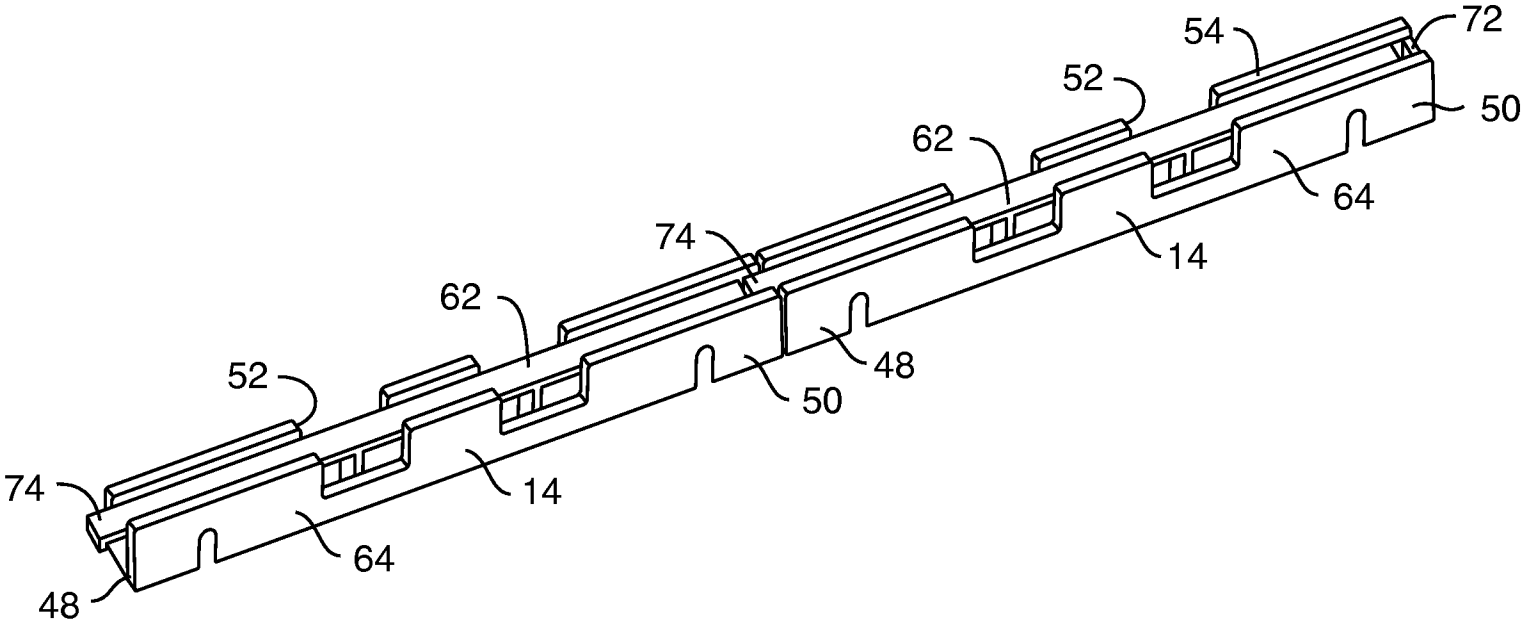
FIG. 11 is a perspective view of two brackets connected to each other.

An alternate embodiment of the fastener 70 is shown in FIGS. 10 and 11 wherein the second interlocking portion is a hook and the first interlocking portion 72 is an aperture (not shown). As seen in FIG. 11, the second interlocking portion 74 (hook) on the bracket 14 extends into and engages the first interlocking portion 72 (aperture) on an adjacent bracket 14. There are many suitable ways to releasably connect a group of brackets 14, trays 12 and messaging panels 16 to form a wide variety of product display systems which would be suitable to display many products for use.

We claim:

1. A product display system comprising:

at least two trays in a side-by-side configuration, each tray including a product recess, the product recess including at least three surfaces configured to support packaged products, wherein the product recess for a first of the at least two trays defines a polyhedron shape, the product recess for a second of the at least two trays defines a non-polyhedron shape and the at least two trays are removably joined;

at least one slot extending into at least one of the surfaces, and a ridge extending downwardly from the same surface into which the at least one slot extends;

at least one bracket comprising a first end and a second end, at least two walls spaced part from and extending parallel to each other, each wall including an upper edge and a lower edge, wherein each wall is configured to engage at least one tray so that the upper edge of the wall is positioned behind the ridge of the tray, at least one notch formed in the upper edge of at least one wall;

a fastener having two interlocking portions, each portion located at an opposite end of the bracket, wherein two brackets may fastened together in an end-to-end configuration by engaging the interlocking portions on the ends of the brackets;

a panel having a first surface and at least one projection wherein the projection is adapted to engage the at least one slot in the tray.

2. The product display system of claim 1 further including at least one supporting wall.

3. The product display system of claim 2 further including at least one brace positioned on the supporting wall, the brace positioned below and spaced apart from at least one slot.

4. The product display system of claim 1 wherein the product recess is configured to accept at least two packaged products, each packaged product having a different lower exterior configuration than the other packaged product.

5. The product display system of claim 4 wherein the product recess is further configured to accept at least two additional packaged products.

6. The product display system of claim 1, wherein the first of the at least two trays has a rounded corner and the second of the at least two trays has four square corners.

7. The product display system of claim 1 further including at least one supporting wall further including at least one brace positioned on the supporting wall the brace aligned with and spaced apart from at least one slot and wherein the product recess is configured to accept at least two packaged products.

8. The product display system of claim 1 wherein the product recess is further configured to accept at least two additional packaged products.

9. The product display system of claim 1 further including a partition positioned between the two walls of the bracket.

10. The product display system of claim 1 including at least two panels.

11. The product display system of claim 1 wherein the at least one slot in the tray extends through at least one of the surfaces.

* * * * *